US006029321A

United States Patent [19]

Fisher

[11] Patent Number: 6,029,321

[45] Date of Patent: Feb. 29, 2000

[54] HAND TOOL SUPPORT STRAP

[76] Inventor: Dale P. Fisher, 18055 Bushard St., Fountain Valley, Calif. 92708

[21] Appl. No.: 09/221,734

[22] Filed: Dec. 28, 1998

[51] Int. Cl.[7] ..... A44B 18/00; A44B 21/00; F41C 27/00

[52] U.S. Cl. ..... 24/306; 24/3.13; 24/17 B; 24/442; 124/35.2

[58] Field of Search ..... 24/306, 442, 17 B, 24/3.13, 16 R; 124/35.2

[56] References Cited

U.S. PATENT DOCUMENTS

| | | | |
|---|---|---|---|
| 3,640,273 | 2/1972 | Ray | 24/306 |
| 3,947,927 | 4/1976 | Rosenthal | 24/306 |
| 4,856,149 | 8/1989 | Brame | 24/442 |
| 4,878,274 | 11/1989 | Patricy | 24/306 |
| 4,982,522 | 1/1991 | Norton | 42/85 |
| 5,056,253 | 10/1991 | Willumsen | 42/94 |
| 5,323,754 | 6/1994 | Pittman et al. | 24/306 |
| 5,603,591 | 2/1997 | McLellan | 24/442 |
| 5,845,374 | 12/1998 | Briggs | 24/306 |

*Primary Examiner*—Victor N. Sakran
*Attorney, Agent, or Firm*—William L. Chapin

[57] ABSTRACT

A support strap for hand tools, hand guns and other hand-held implements having a pistol grip-type handle includes an elongated strip of flexible material having a ring attached to a first transverse end of the strip. A first fastener member is attached to the lower surface of the strip, proximate the second transverse end or tip of the strip, and a second fastener member releasably engageable with the first fastener member is attached to the upper surface of the strip. The strap is used by inserting the tip of the strap through the ring to form a first, wrist loop, into which loop the hand is inserted, and the free end pulled with a tension sufficient to tighten the loop to a desired tightness around the wrist of a user. The inner diameter of the loop is preferably slightly less than the width of the strip, thereby frictionally gripping the edges of the strap. With the wrist loop of the strap thus attached to a person's wrist, the handle of a hand tool may be grasped and the tip of the strap pulled forward between the index finger and forefinger. The free end of the strap is then wrapped rearward around the handle to form a handle loop, around the thumb rearward of the rear joint of the thumb, and around the wrist to overlie the wrist loop. The free end is then pulled to tighten the handle loop to a desired degree, i.e., pressing the handle into the palm with desired force, whereupon the first fastener member on the lower surface of the strip is releasably engaged with the second fastener strip. In the preferred embodiment, the first fastener strip on the underside of the strip comprises a strip of VELCRO hook-type material, and the second fastener member comprises a length of VELCRO-type loop pile material that spans a substantial portion of the length of the upper surface of the strip.

7 Claims, 6 Drawing Sheets

Fig. 3
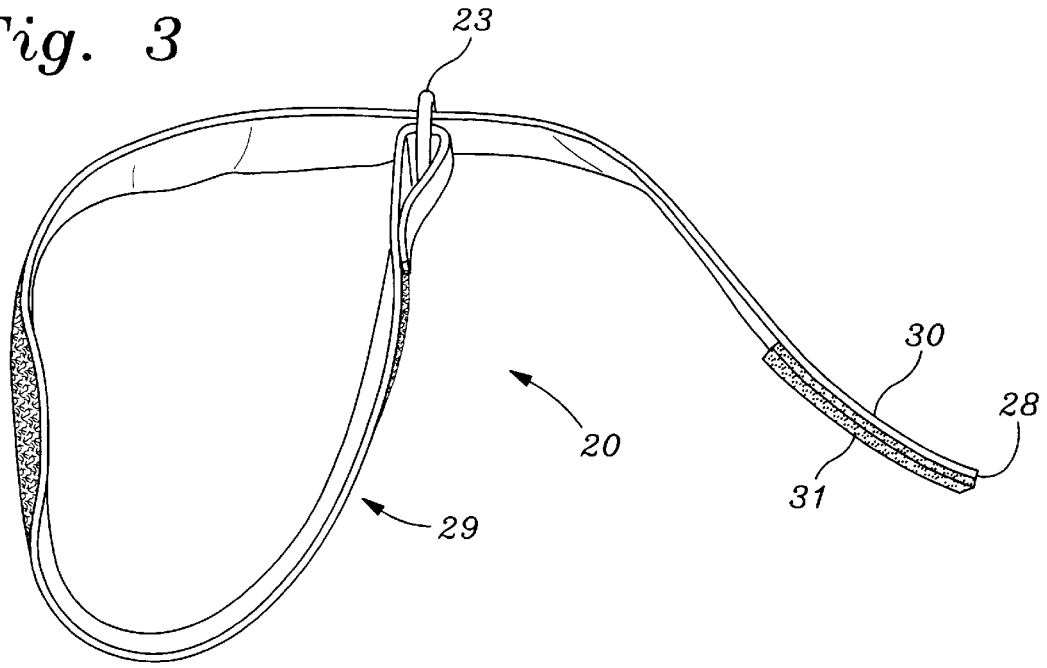
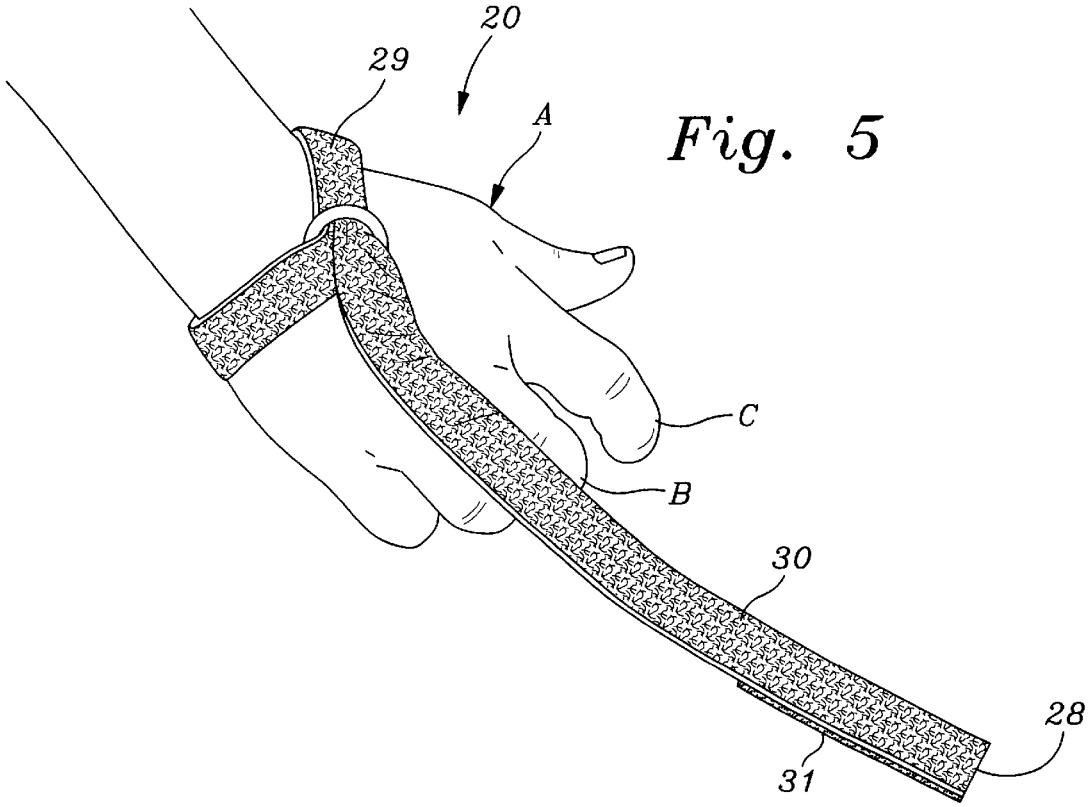
Fig. 5

HAND TOOL SUPPORT STRAP

BACKGROUND OF THE INVENTION

A. Field of the Invention

The present invention relates to accessories for use with hand-held implements such as hand tools and hand guns. More particularly, the invention relates to an accessory strap releasably fastenable to both the hand and wrist of a user and to a hand tool or other such implement, to increase the comfort, efficiency, and safety of utilization of the implement.

B. Description of Background Art

A variety of unpowered hand tools such as hacksaws and powered hand tools such as electric drills are used by both amateur and professional mechanics, craftsmen and the like. Many such hand tools are provided with a pistol-grip type handle that permits the tool to be conveniently and firmly grasped and used. In certain applications, however, it would be desirable to provide means for providing a more secure grip on hand-held tools or implements. Thus, for example, when a workman must ascend a ladder, or work on a roof or other such relatively precarious location. inadvertent dropping of a tool which was held in the hand may be somewhat more problematic than merely dropping the tool on the ground or on the floor of a workshop or other room. When the tool is powered, even more serious consequences can result. For example, the present inventor is aware of cases where a pneumatic nailing machine has fired a nail into the leg of a workman when the machine slipped from the grasp of the workman, and impacted the roof on which he was working. Accordingly, it would be desirable to provide an efficient means for releasably securing hand tools to the hand of a user, to prevent damage to the individual using the tool, or the tool itself, which might occur if the tool slipped from the grasp of the user and fell to the ground In addition to the problem posed by inadvertent dropping of hand tools, a potentially more serious problem can result from the inadvertent dropping of a hand gun, because the accidental discharge of the gun which might result from its being dropped could inflict a fatal wound. Furthermore, the use of a relatively heavy hand gun in a self-defense mode, particularly by a woman, can be especially problematic. Accordingly. it would be desirable to provide means for releasably securing a hand gun to the hand of a user, to minimize the likelihood that the gun could be accidentally dropped or seized by an assailant, as well as to steady the aim of the user.

The following United States patents discloses articles intended for use in securing a gun to the hand of a user:

Norton, U.S. Pat. No. 4,982,522, Jan. 8, 1991, Gun Safety Lanyard: Discloses a safety lanyard for long guns such as rifles and shotguns for reducing the risk of accidentally discharge by dropping the gun onto the ground- The gun safety lanyard (10) includes an endless loop of flexible cord (16) having a first, front sub-loop at an end (20) intended to be looped around the portion of a gun stock rearward of the receiver of a long gun (12), and a second, rear sub-loop (22) which is inserted into the first sub-loop and pulled rearward to form a clove-hitch type knot tightened on the stock. The rear sub-loop (22) is preferably provided with an enlarged width band (24) made of a fabric or other material which may be tightened comfortably against the wrist of a hunter, by means of a slide clasp (18) which has two adjacent apertures for slidably receiving adjacent cord lengths of rear loop (22).

Canon, U.S. Pat. No. 3,553,878, Jan. 12, 1971, Means For Supporting And Aiming A Hand-Held Device: Discloses a hand brace (10) including a telescopically adjustable rigid shoulder stock (36) for use with hand guns, and a flexible strap attached to the front end of the stock, the strap having formed therein a permanently sewn loop (20) adapted to receive the thumb or finger of a shooter's hand and elongated free ends (16) and (18) of sufficient length to be looped around the palm of the shooter's hand, and secured thereto by mating VELCRO fastener strips (26), (28).

Willumsen, U.S. Pat. No. 5,056,253, Oct. 15, 1991, Handgun Stabilizing Strap: Discloses a handgun stabilizing strap 10 in the form of an elongated, flexible, inelastic webbing strap 16 having an adjustable neck encircling loop 20 at one end and a thumb engaging loop 24 at the other end. The large neck encircling loop is placed around the shooter's neck and the small loop at the other end of the strap is placed around the thumb of the handgun shooter's shooting hand to stabilize the handgun while it is being aimed and while the trigger is being pulled when shooting the gun.

Other U.S. patents related generally to securing objects to the hand of a person during use include the following:

Bacharach, U.S. Pat. No. 5,328,205, Jul. 12, 1994, Combination Ski Pole And Hand Strap; Stinemates, U.S. Pat. No. 4,754,498, Jul. 5, 1998, Gun Mitten; Ingold, U.S. Pat. No. 3,770,270, Nov. 6, 1973, Bowling Aid Glove; and Morse, U.S. Pat. No. 3,880,426, Apr. 29, 1975, Wrist And Finger Support For Bowlers.

None of the foregoing references discloses an article which is releasably attachable to a variety of unmodified hand tools or implements and which both secures a person's grip on the implement and prevents the implement from being dropped, even if the user's grip on the handle of the implement is loosened. The present invention was conceived of to satisfy a perceived need for an article having the foregoing characteristics.

OBJECTS OF THE INVENTION

An object of the present invention is to provide a support strap for hand tools, hand guns, and other such implements having a pistol grip type handle adapted to be grasped in a person's hand, the support strap securing the handle of the implement within the grasp of a person.

Another object of the invention is to provide a hand tool support strap which may be attached to a person's wrist, and releasably attached to the handle of a hand-held implement to thereby secure the handle within the grasp of the person.

Another object of the invention is to provide a hand tool support strap in which a wrist loop adjustable in size to fit various size wrists is formed near one end of the strap for insertably receiving a person's hand, the strap having a free end which may be pulled forward from the wrist loop, looped backwards around the handle of an implement held in the grasp of the person's hand, pulled backwards to simultaneously tighten the wrist loop around the wrist and tighten an intermediate portion of the strap around the implement handle to form a handle loop, the front portion of the strap being provided with a fastener releasably attachable to the wrist loop at a selected location resulting in a desired tension of the handle loop and wrist loop.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a hand tool support strap which may be used to secure to the hand of a user the handle of a hand tool, hand gun or similar implement provided with a pistol grip type handle.

The hand tool support strap according to the present invention includes an elongated length of flexible strapping material having at a first, rear end thereof a noose-type wrist loop which may receive a person's hand and be tightened on the person's wrist. The hand tool support strap includes a fastener attached to the second, front end thereof which is releasably attachable to a selected location on the wrist loop. Thus constructed, the free front end portion of the strap may be inserted forward between the index and forefinger, looped around the handle of a tool held within a person's grasp to form a handle loop, pulled rearward below the thumb, wrapped a desired distance over the wrist loop, and secured at a desired tension to the wrist loop

BRIEF DESCRIPTION OF THE DRAWINGS

FIG. 3 is a perspective view of the strap of FIG. 1, showing a free end of the strap inserted through a ring thereof to form a wrist loop.

FIG. 5 is a perspective view showing the right hand of a person inserted through the wrist loop of the strap of FIG. 3.

DESCRIPTION OF THE PREFERRED EMBODIMENTS

FIGS. 1–11 illustrate the construction and use of a hand tool support strap according to the present invention.

Figure 1:
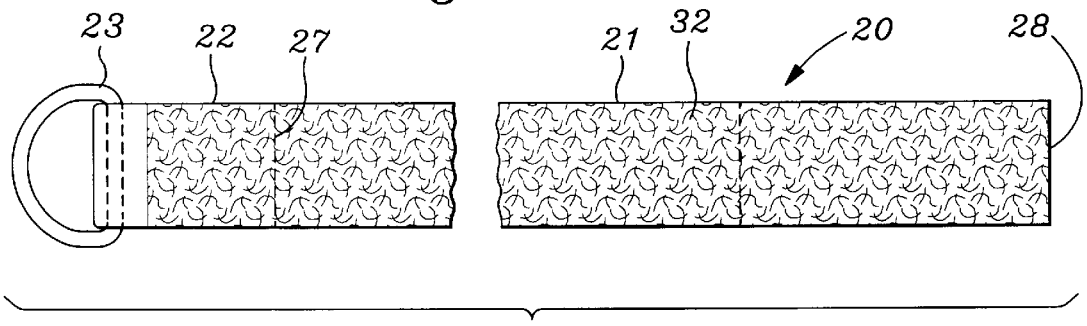
FIG. 1 is an upper plan view of a hand tool strap according to the present invention.
Figure 2:
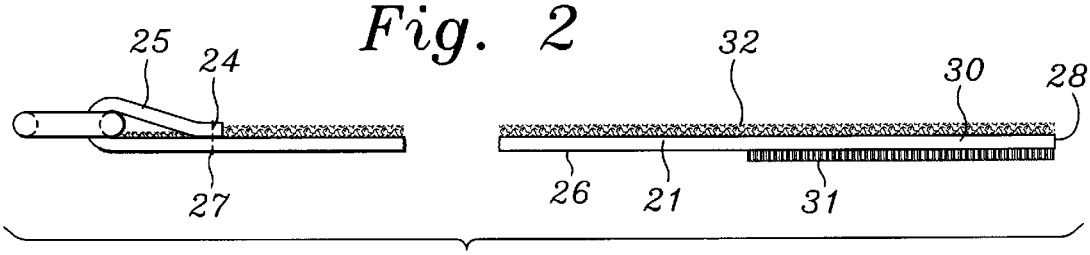
FIG. 2 is a side elevation view of the strap of FIG. 1.

Referring first to FIGS. 1 and 2, hand tool support strap 20 according to the present invention may be seen to include an elongated rectangular strip 21 made of flexible material, preferably a synthetic fabric such as nylon. At a first, rear end 22 of the strap, a ring 23 is attached, by any convenient means. Preferably, as shown in FIGS. 1 and 2, ring 23 is attached to strap 21 by inserting rear tip 24 of strap 21 through ring 23, looping the rear end of the strap forward around the ring to form a loop 25 which contacts the underside 26 of strap 21, and securing the rear end of the strap to the underside of the strap by sewn stitches 27.

Figure 4:
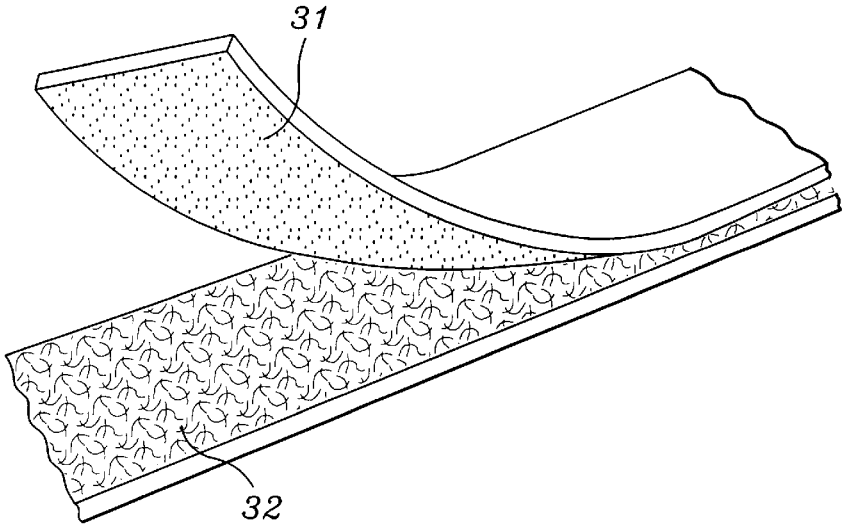
FIG. 4 is an enlarged scale perspective view of the strap of FIG. 1, showing how a hook-type fastener strip on the lower surface of one end of the strap engages pile loops on the upper surface of the strap.

Referring now to FIG. 3, it may be seen that strap 20 is prepared for use by looping the front tip 28 of free end portion 30 of strap 21 rearward, inserting the tip through ring 23, and pulling the tip forward to form a wrist loop 29. Hand tool support strap 20 includes means for attaching the front end portion 30 of the strap to wrist loop 29. Thus, as shown in FIGS. 1, 2 and 4, a fastener strip 31 consisting of a length of VELCRO type hook tape is fastened to the underside 26 of strap 21, extending rearward from tip 28. Strap 20 includes a pile loop-type fastener strip 32 on the upper side of wrist loop 29. In the preferred embodiment, pile loop-type fastener strip 32 is relatively longer than hook fastener strip 31, allowing the hook fastener strip to be secured to the pile loop fastener strip at different locations on wrist loop 29. Thus, as shown in FIGS. 1 and 2, pile loop fastener strip 32 may cover the entire upper surface of flexible fabric strip 21.

The manner of using hand tool support strap 20 may be best understood by referring to FIGS. 5–9.

Figure 6:
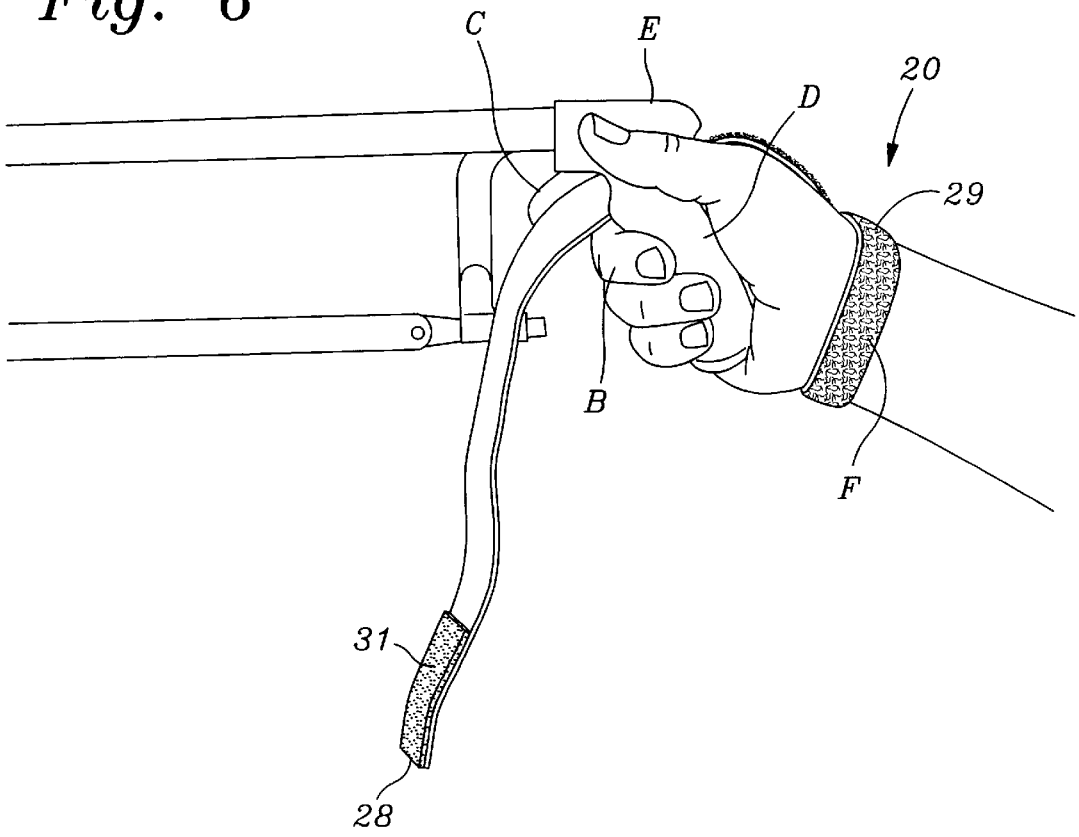
FIG. 6 is a perspective view showing a tool being gripped by a person's hand and the free end of the strap inserted forward between the index finger and forefinger and looped rearward to form a handle loop.
Figure 7:
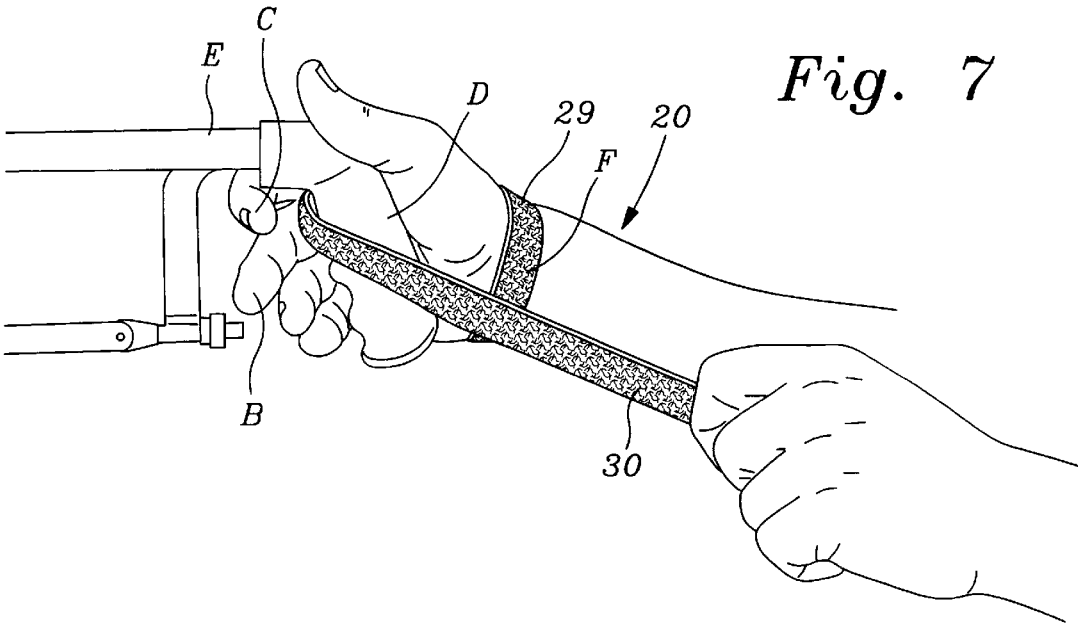
FIG. 7 is a view similar to that of FIG. 6, but showing the free end of the strap pulled rearward to tighten the handle loop around the tool handle.
Figure 8:
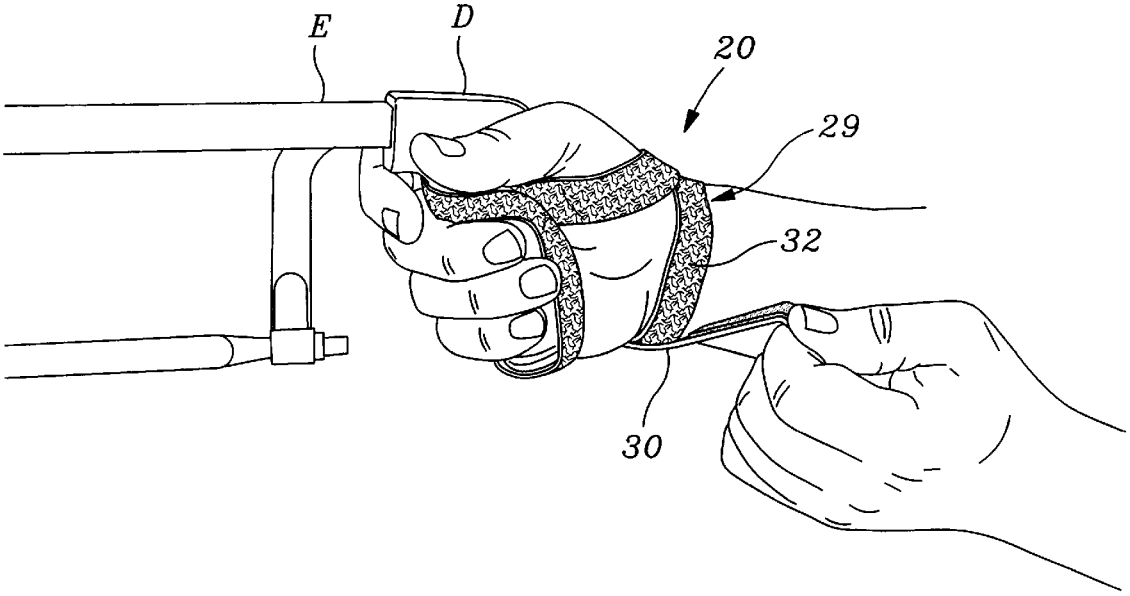
FIG. 8 is a view similar to that of FIG. 7, but showing the free end of the strap wrapped counterclockwise over and around the wrist loop thereof, and protruding laterally outwards from the underside of the loop.

Referring now to FIG. 3, it may be seen that hand tool support strap is prepared for use by inserting tip 28 through ring 23 to form a wrist loop 29. Next, as shown in FIG. 5, the right-hand A (or left hand of a left-handed person) is inserted forward through wrist loop 29 of hand tool support strap 20. Then, as shown in FIG. 6, tip 28 of strap 20 is inserted from the upper side of a person's hand between the index finger B and forefinger C to exit at the palm side of the hand. As shown in FIGS. 6 and 7, the handle D of a hand tool E such as a hacksaw is then grasped tightly in hand A, and free end 28 of strap 20 is looped around the handle and pulled rearward toward the wrist F of the person. Next, as shown in FIG. 8, free end 30 of strap 20 is looped backwards around the portion of tne thumb rearward of the rear joint thereof, over the top of the hand and partially overlying and partially around wrist loop 29. From the perspective of a right-handed person looking forward, the strap 20 is looped clockwise for the step described above and depicted in FIG. 8.

Figure 9:
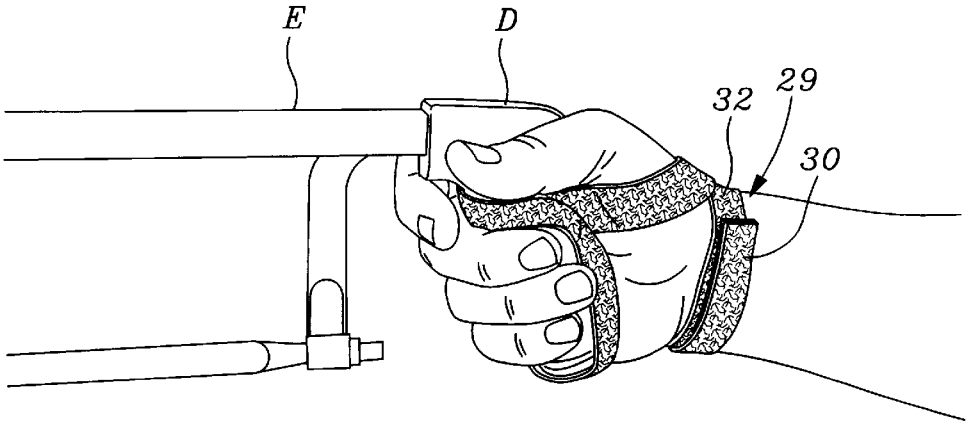
FIG. 9 is a view similar to that of FIG. 8, but showing the free end of the strap fastened to the upper surface of the wrist loop by releasable fasteners, thereby securing a tool to the arm of a user.

Referring now to FIGS. 8 and 9, it may be seen that after free end 30 of strap 20 has been looped around the wrist to overlie wrist loop 29, and pulled on with sufficient tension to press handle D of tool E into the palm of a person's hand with a desired securing pressure, hook-type fastener strip 31 may be pressed downwardly into the pile loop fastener strip 32 on the upper surface of wrist loop 29, thus releasably fastening strap 20 at a desired tension around the hand tool handle and the person's hand.

Figure 10A:
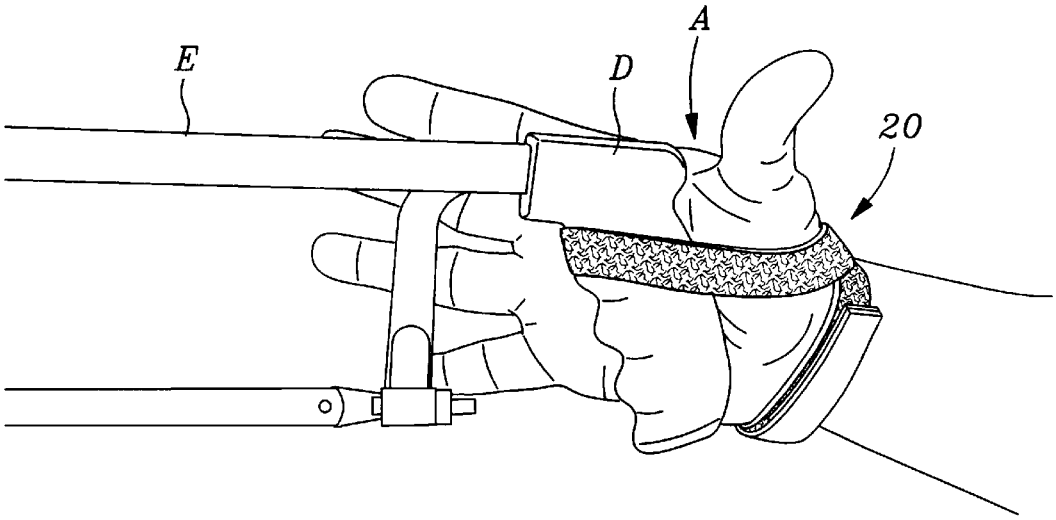
FIG. 10 is a perspective view showing a tool maintained securely to the hand of a user, even with the fingers of the person released from a position gripping the handle of the tool.
Figure 10B:
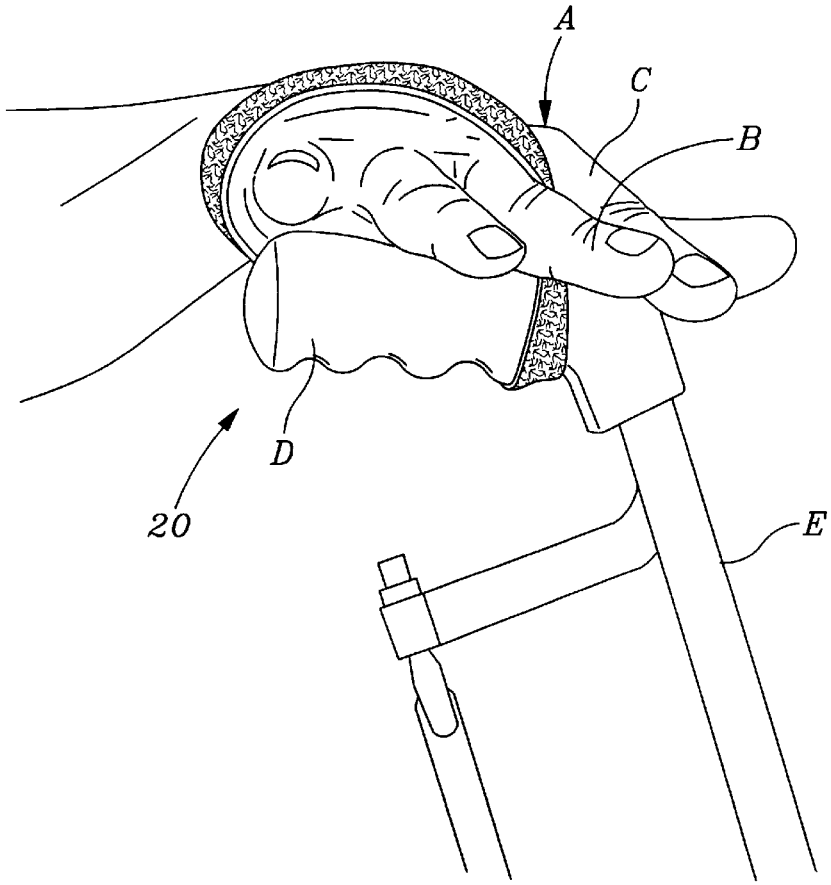
Figure 10C:
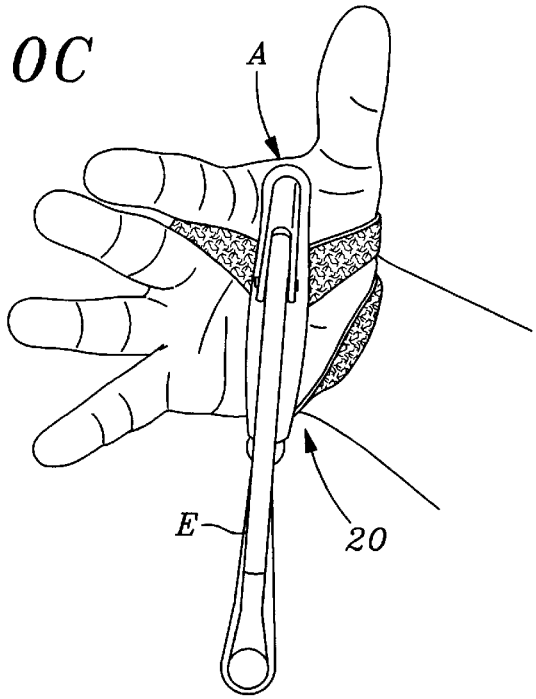

With hand tool E secured to a person's hand A by strap 20 in the manner described above, the tool is prevented from inadvertently falling from the person's hand. Thus, as shown in FIG. 10A, the fingers and thumb may be straightened from a curled position grasping handle A, to a completely flat, open-palm position, with no finger or thumb contacting the handle, while the handle remains secured to the palm of the hand by strap 20. As shown in FIGS. 10B and 10C, with tool E secured to hand A by strap 20, the hand may even be turned palm down with the tool suspended vertically downwards yet safely secured by the strap from dropping from the hand.

Figure 11:
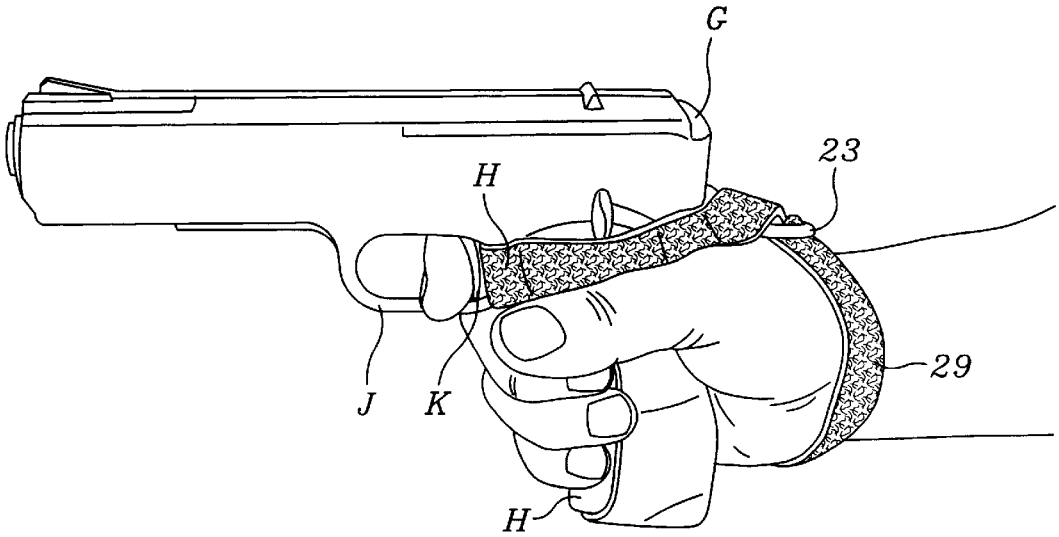
FIG. 11 is a perspective view similar to that of FIG. 7, but showing the strap according to the present invention securing a hand gun to the hand of a person.

FIG. 11 is a perspective view illustrating a variation in the manner of using strap 20 depicted in FIGS. 5–10 and described above. As shown in FIG. 11, a hand gun G having pistol grip handle H includes a trigger guard J, and in this case, tip 28 of strap 20 may be inserted from the right side of the gun between the front inner surface of the trigger guard and the rear surface of the trigger K, rather than around the front surface of handle H. With strap tip 28 thus positioned, the strap is looped around the thumb and wrist and releasably fastened to wrist loop 29 in the same manner as depicted in FIGS. 6–8 and described above. Thus secured, the hand gun is secured to the hand of the user in spite of any temporary release of the person's grip on the handle of the gun, and even if grabbed by an assailant. Moreover, the present inventor has found the strap according to the present invention, utilized as described above, substantially steadies the gun and improves aim, whether in a confrontational or sporting situation.

what is claimed is:

1. A support strap for securing the handle of a hand-held implement to a hand of a user comprising;

a. a longitudinally elongated strap of flexible material having first and second transversely disposed longitudinal ends, b. a ring secured to said first end of said strap, said ring adapted to insertably receive said second end of said strap to thereby form a first, wrist loop adapted to insertably receive said hand of said user and be tensioned to tighten said wrist loop to an adjusted size around the wrist of said user, c. resisting means for resisting motion of said strap through said ring, thereby maintaining said first, wrist loop at said adjusted size, d. a first fastener member attached to the underside of said strap proximate said second end of said strap, and e. a second fastener member located on the upper surface of said strap, said second fastener member releasably engageable with said first fastener member with said first fastener member located a selectable distance relative to said first end of said strap, whereby said second end of said strap is inserted through said ring to form said first, wrist loop at a size adjustable to fit wrists of various sizes, looped around a handle of an object held in a hand to form a handle loop which presses said handle into the palm of said hand with a desired force, and secured to said wrist loop by engaging said first and second fastener members.

2. The support strap of claim 1 wherein said first fastener member is further defined as being a length of VELCRO-type, fabric hook tape.

3. The support strap of claim 2 wherein said second fastener member is further defined as being a length of VELCRO-type fabric pile material.

4. The support strap of claim 3 wherein said second fastener member is further defined as having a greater length than said first fastener member.

5. The support strap of claim 4 wherein said second fastener member is further defined as comprising substantially the entire upper surface of said strip.

6. The support strap of claim 1 wherein said resisting means is further defined as comprising frictional contact between said strap and said ring whereby longitudinal motion of said strap through said ring is frictionally retarded.

7. The support strap of claim 6 wherein the width of said strap is greater than the maximum diameter of said ring.

* * * * *